US010070671B2

(12) United States Patent
Moran

(10) Patent No.: US 10,070,671 B2
(45) Date of Patent: Sep. 11, 2018

(54) ARTICLE OF CLOTHING

(71) Applicant: Timothy Moran, Soquel, CA (US)

(72) Inventor: Timothy Moran, Soquel, CA (US)

( * ) Notice: Subject to any disclaimer, the term of this patent is extended or adjusted under 35 U.S.C. 154(b) by 0 days.

(21) Appl. No.: 15/206,682

(22) Filed: Jul. 11, 2016

(65) Prior Publication Data

US 2016/0316824 A1 Nov. 3, 2016

Related U.S. Application Data

(63) Continuation-in-part of application No. 15/066,842, filed on Mar. 10, 2016, which is a continuation of application No. 14/081,447, filed on Nov. 15, 2013, now Pat. No. 9,314,055.

(60) Provisional application No. 61/734,659, filed on Dec. 7, 2012.

(51) Int. Cl.

| | |
|---|---|
| ***A41D 27/00*** | (2006.01) |
| ***A41D 1/06*** | (2006.01) |
| ***A41B 11/00*** | (2006.01) |
| ***A41D 27/20*** | (2006.01) |
| ***A41D 19/00*** | (2006.01) |

(52) U.S. Cl.

CPC ..... *A41D 1/06* (2013.01); *A41B 11/007* (2013.01); *A41D 19/0017* (2013.01); *A41D 27/201* (2013.01)

(58) Field of Classification Search

CPC .... A41D 1/06; A41D 19/0017; A41D 27/201; A41B 11/007

See application file for complete search history.

(56) References Cited

U.S. PATENT DOCUMENTS 1,283,205 A * 10/1918 Jones ..... A41D 10/00 2/83
1,393,900 A * 10/1921 Milkes ..... A41D 10/00 2/83
1,525,473 A * 2/1925 Thomas ..... A41D 10/00 2/239
1,741,340 A * 12/1929 Scholl ..... A41B 11/006 2/239
1,750,180 A * 3/1930 Marinsky ..... A41D 19/002 2/160
1,849,418 A * 3/1932 Chesebro ..... A41D 19/0017 2/158
2,131,898 A * 10/1938 Milkes ..... A41D 10/00 2/83

(Continued)

*Primary Examiner* — Richale Quinn

(74) *Attorney, Agent, or Firm* — Donald R. Boys; Central Coast Patent Agency, LLC

(57) ABSTRACT

A passage in first fabric of a garment has a substantially rectangular opening sufficient to pass a hand or foot, the opening having a length between a first and a second edge, and a width between a third and a fourth edge, a first flap of fabric joined continuously along the third edge, and from the third edge continuously along the first and second, a second flap of fabric joined continuously along the fourth edge, and from the fourth edge continuously along the first and second edges, the second flap of fabric overlapping the first flap of fabric for at least a portion of the width, wherein a passage is formed between the overlapped flaps, through the substantially rectangular opening, from one side of the first fabric of the garment to the opposite side of the first fabric of the garment.

8 Claims, 9 Drawing Sheets

(56) References Cited

U.S. PATENT DOCUMENTS 2,451,837 A * 10/1948 La Londe ..... A41D 19/01 2/158
2,513,639 A * 7/1950 Goodman ..... A41B 11/00 2/239
2,655,660 A * 10/1953 Racz ..... A41D 10/00 2/239
2,677,130 A * 5/1954 O'Hayer ..... A41B 13/00 2/114
2,705,326 A * 4/1955 Lahnstein ..... A41D 10/00 2/269
2,705,804 A * 4/1955 Walker ..... A41B 13/00 2/269
3,090,963 A * 5/1963 Wittman ..... D05B 23/009 112/162
3,111,676 A * 11/1963 Artzt ..... A41B 13/00 2/227
3,201,800 A * 8/1965 McHugh ..... A41D 15/00 2/227
3,329,972 A * 7/1967 Schwab ..... A41D 11/00 2/239
3,416,518 A * 12/1968 Samuels ..... A61F 15/004 2/16
3,975,929 A * 8/1976 Fregeolle ..... D04B 1/265 2/239
4,021,860 A * 5/1977 Swallow ..... A41B 11/008 2/239
4,054,129 A * 10/1977 Byars ..... A61H 9/0078 601/152
4,181,982 A * 1/1980 Segovia ..... A41B 11/00 2/239
4,475,253 A * 10/1984 Laveckis ..... A41D 27/00 2/232
4,587,672 A * 5/1986 Madnick ..... A41D 19/01535 2/158
4,651,350 A * 3/1987 Dawiedczyk ..... A41D 19/0017 2/158
4,805,242 A * 2/1989 Bolton ..... A41D 19/0024 2/160
5,054,129 A * 10/1991 Baehr ..... A41B 11/004 2/239
5,125,117 A * 6/1992 Buenos ..... A41D 19/0041 2/123
5,473,781 A * 12/1995 Greenberg ..... A41B 11/003 2/239
5,575,013 A * 11/1996 Krack ..... A41B 11/00 2/239
6,047,571 A * 4/2000 Juniman ..... A41B 11/08 2/239
6,286,341 B2 * 9/2001 Jackson, Jr. ..... D04B 21/18 2/221
6,324,698 B1 * 12/2001 Freeman ..... A41B 11/00 2/239
6,338,163 B1 * 1/2002 Markson ..... A41D 19/0017 2/161.6
6,378,139 B1 * 4/2002 Mazzaglia ..... A41B 11/008 2/242
6,415,448 B1 * 7/2002 Glogover ..... A41B 11/00 2/239
7,007,309 B1 * 3/2006 Mende ..... A41B 11/14 2/239
7,310,825 B2 * 12/2007 St-Germain ..... A41D 27/10 2/123
7,533,424 B2 * 5/2009 Symonds-Powell ... A41B 11/00 2/239
7,669,252 B2 * 3/2010 Wei ..... A41B 11/08 2/239
8,205,271 B2 * 6/2012 Canci ..... A44B 11/02 2/239
8,356,365 B2 * 1/2013 Wolfson ..... A41D 10/00 2/111
8,904,566 B2 * 12/2014 Clark ..... A41D 19/01 2/158
2002/0108166 A1 * 8/2002 Abboud ..... A41B 11/14 2/239
2006/0130218 A1 * 6/2006 Burry ..... A41B 11/00 2/239
2008/0034477 A1 * 2/2008 Symonds-Powell ... A41B 11/00 2/239
2008/0168683 A1 * 7/2008 Keating ..... A43B 1/0081 36/102
2009/0300823 A1 * 12/2009 Connaghan ..... A41B 11/006 2/241
2011/0131702 A1 * 6/2011 Rodgers ..... A41D 19/002 2/158
2011/0289656 A1 * 12/2011 Witte ..... A41B 11/006 2/239
2013/0174325 A1 * 7/2013 Yang ..... A41B 11/005 2/239
2013/0291293 A1 * 11/2013 Jessiman ..... A43B 1/04 2/459
2014/0250565 A1 * 9/2014 Willows ..... A41D 19/002 2/160
2015/0074872 A1 * 3/2015 Seawell ..... D04B 1/26 2/242

* cited by examiner

ARTICLE OF CLOTHING

CROSS-REFERENCE TO RELATED DOCUMENTS

The present invention is a continuation-in-part application to co-pending U.S. application Ser. No. 15/066,842, filed Mar. 16, 2016, which is a continuation application to U.S. Ser. No. 14/081,447, filed on Nov. 15, 2013, which claims priority to U.S. provisional patent application 61/734,659, entitled "Method and Apparatus for Incorporating Booties with Clothing Bottoms", filed on Dec. 7, 2012. Disclosures of parent applications are incorporated herein at least by reference.

BACKGROUND OF THE INVENTION

1. Field of the Invention

The present invention is in the field of clothing including sweatpants and sleepwear and pertains particularly to methods and apparatus for providing foot coverings with at least one opening for extending the foot through the covering to the outside.

2. Discussion of the State of the Art

In the field of retail clothing, more particularly sweatpants and sleepwear, pants exist that include foot coverings commonly referred to as booties on the end of the pant legs. Booties completely cover the foot when wearing such articles of clothing. One problem with the booties is that under certain circumstances the wearer's feet become too warm while wearing the article necessitating removal of a portion of or the entire article of clothing.

Therefore, what is clearly needed is an article of clothing including booties or footies that solves the above mentioned problem.

SUMMARY OF THE INVENTION

In one embodiment of the invention a protected passage in first fabric of a garment is provided, comprising a substantially rectangular opening through the first fabric of an area sufficient to pass a hand or foot, the opening having a length between a first and a second edge, and a width between a third and a fourth edge, a first flap of fabric, different from the first fabric, joined to the substantially rectangular opening continuously along the third edge, and from the third edge continuously along the first and second edges for a distance more than one-half the width on each of the first and second edges, and a second flap of fabric, different from the first fabric, joined to the substantially rectangular opening continuously along the fourth edge, and from the fourth edge continuously along the first and second edges for a distance more than one-half the width on each of the first and second edges, the second flap of fabric overlapping the first flap of fabric for at least a portion of the width. A passage is formed between the overlapped flaps, through the substantially rectangular opening, from one side of the first fabric of the garment to the opposite side of the first fabric of the garment.

In one embodiment one or both of the first and the second flaps are formed of fabric elastic in one or both directions of the width and the length of the substantially rectangular opening. Also in one embodiment elasticity is sufficient to allow one or both flaps to deform sufficiently to pass a human hand or foot. Also in one embodiment the passage is implemented in the sole region of a foot covering of a garment, the length of the substantially rectangular opening oriented across the sole at a right angle to a direction from a heel area to a toe area of the foot covering.

In one embodiment the passage is implemented on a region of a foot covering of a garment below the ankle area and above the sole of the foot covering. Also in one embodiment the passage is implemented in the back of a glove or mitten hand covering of an upper garment. Also in one embodiment the passage is implemented in the palm region of a glove or mitten hand covering of an upper garment. In one embodiment the width of the first and second flaps are substantially equal to the width of the substantially rectangular opening. And in one embodiment the passage further comprises reinforcement added along one or more of the edges of the substantially rectangular opening.

BRIEF DESCRIPTION OF THE DRAWING FIGURES

DETAILED DESCRIPTION

The inventor provides an article of clothing, in one embodiment, sweatpants that include foot coverings with openings provided therein for the feet to be optionally extended through to the outside. The present invention is described in enabling detail using the following examples, which may describe more than one relevant embodiment falling within the scope of the present invention.

Figure 1:
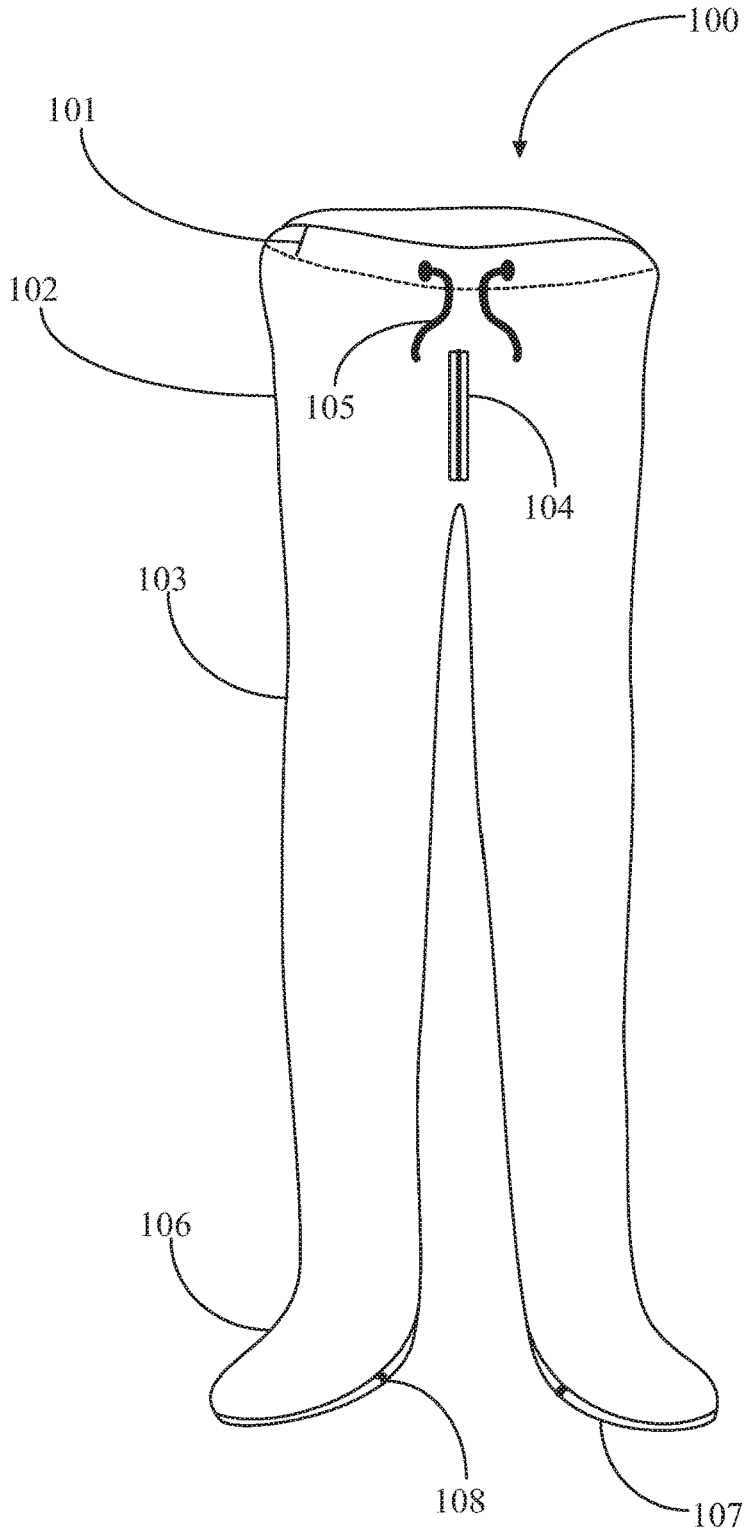
FIG. 1 is an elevation view of an article of clothing according to an embodiment of the present invention.

FIG. 1 is an elevation view of a clothing article 100 according to an embodiment of the present invention. Clothing article 100, in this embodiment, is a garment commonly referred to as sweatpants in the art. Sweatpants 100 may be fabricated of a durable and soft material such as a cotton blend interwoven with an absorbent heat retention material like fleece. Clothing article 100 includes a waist band 101. Waist band 101 may include drawstrings 105. Drawstrings 105 may be utilized to tighten the clothing article, in this case sweatpants, at the waist. In another embodiment waistband 101 is fabricated from an elastic stretchable material. In one embodiment sweatpants 100 include a seat or seat portion 102. Seat portion 102 may be reinforced, lined, or padded with supplemental materials in one embodiment. In another embodiment the seat is fabricated from the same material as the sweatpants.

In one embodiment, sweatpants 100 include a fly 104. Fly 104 may be a flap opening, a zippered opening, or a buttoned opening without departing from the spirit and scope of the present invention. In one embodiment sweatpants 100 may include one or more pockets (none illustrated) without departing from the spirit and scope of the present invention. In one embodiment sweatpants 100 may be attached to a top garment such as a sweat jacket, wind breaker, or some other top garment. Mechanisms of attaching sweatpants to a garment top piece might include hook and loop, snaps, buttons, hooks, zipper, or the like.

Sweatpants 100 include pant legs 103. Pant legs 103 may include fleece material for retaining warmth and absorbing moisture. Each pant leg culminates into a foot covering 106. Foot covering 106 is sewn into pant leg 103 in this embodiment. In another embodiment foot covering 106 may be a contiguous part of the sweatpants material. Foot covering 106 completely encloses the wearer's foot. Foot covering 106 may also be referred to in the art as a bootie or footie.

Foot covering 106 in one embodiment includes an opening 108 provided on the sole of the foot covering in a direction substantially orthogonal to the direction of the wearer's foot. In this view only a far end of the opening is visible. Opening 108 is adapted to enable the wearer to extend the foot through the opening to the outside. Opening 108 may be provided through a resilient stretch material 107 that is used to fabricate the sole of foot covering 106. More detail about opening 108 is included later in this specification.

Figure 2:
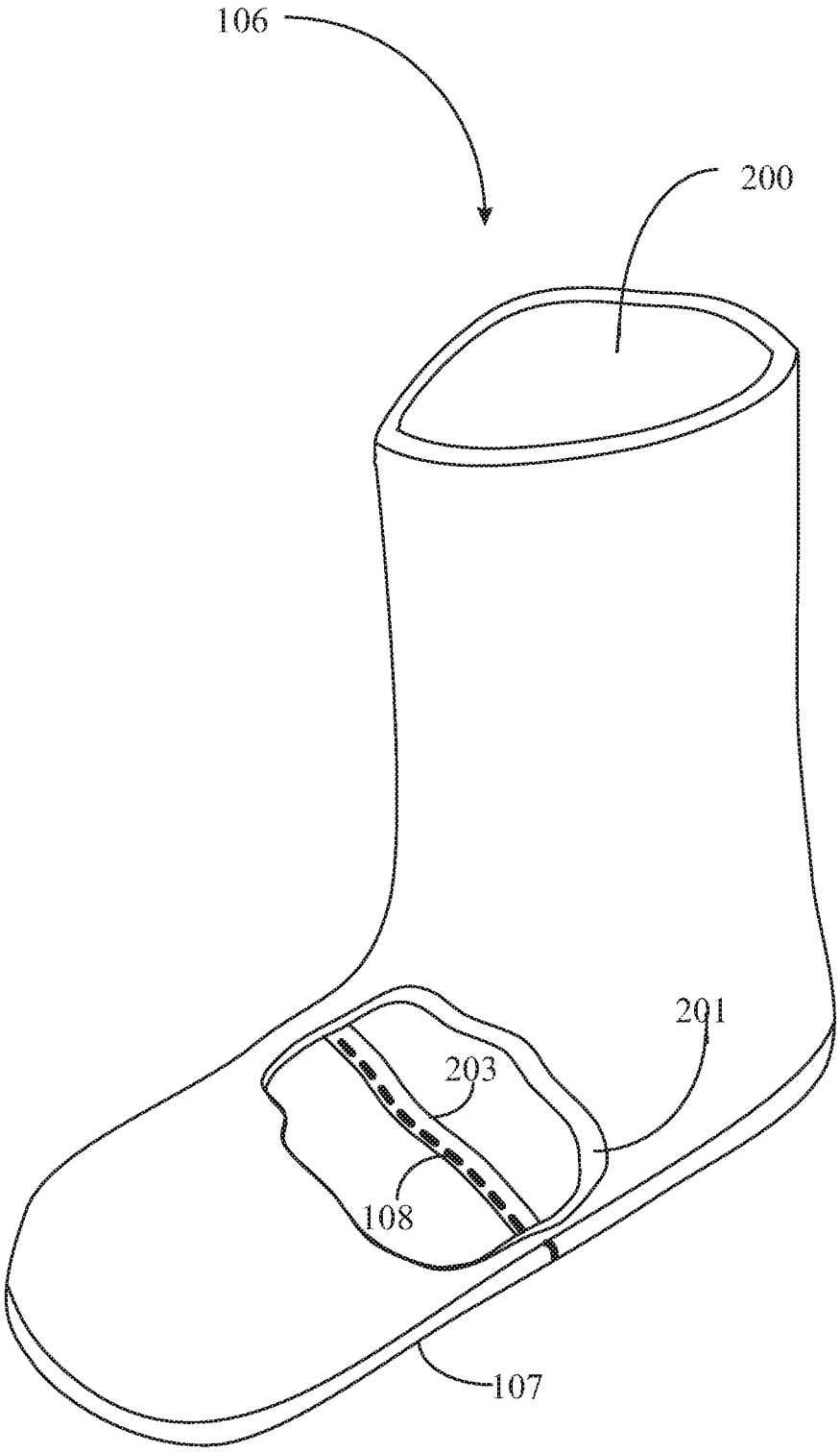
FIG. 2 is a perspective view of a foot covering of the article of clothing of FIG. 1.

FIG. 2 is a perspective view of foot covering 106 of the clothing article of FIG. 1. Foot covering 106 is depicted separated from sweatpants 100 to illustrate more detail. Foot covering 106 is separated above the ankle region in this example and depicts a fleece lining 200 that may or may not extend into the foot covering to just above or approximately near the ankle region of the bootie. In this embodiment a portion of foot covering 106 is removed to expose opening 108. The foot portion or region of foot covering 106 may, in one embodiment, be lined on the inside with a Sherpa material 201. Sherpa is a commonly used synthetic material designed to retain warmth and absorb moisture.

Opening 108 may be a slit opening provided through the sole of foot covering 106, in this case, across the sole of the foot covering substantially orthogonal to the direction of the foot in the bootie. Opening 108 may be a "hidden opening" covered by a flap 203. Opening 108 may be held together by a fastening mechanism such as a hook and loop connection, snaps, zipper, magnetic strip, buttons, or the like, but may in some embodiments not be fastened. In one embodiment opening 108 is provided with protective flaps or coverings on both the upper surface and bottom surface of the sole of the foot covering. The protective flaps may keep foreign material from entering the opening through the bottom of the sole and also may protect fasteners such as snaps or buttons from direct contact with the floor or ground surface while walking with the feet inside the foot coverings.

In one embodiment, the opening 203 is not fastened or otherwise closed. In this embodiment protective flap materials may be provided to cover the opening. In another embodiment opening 108 may be provided roughly centered in a Z-cut design provided vertically through the sole of the foot covering that provides a contiguous flap or stretch material on both sides of the opening. This configuration may also include a zipper or other fastening mechanism operated from the outside of the foot covering to close the opening. Such a mechanism might be accessible by lifting the flap on the bottom sole. In another embodiment foot covering 106 might be detachable from sweatpants 106.

Figure 3:
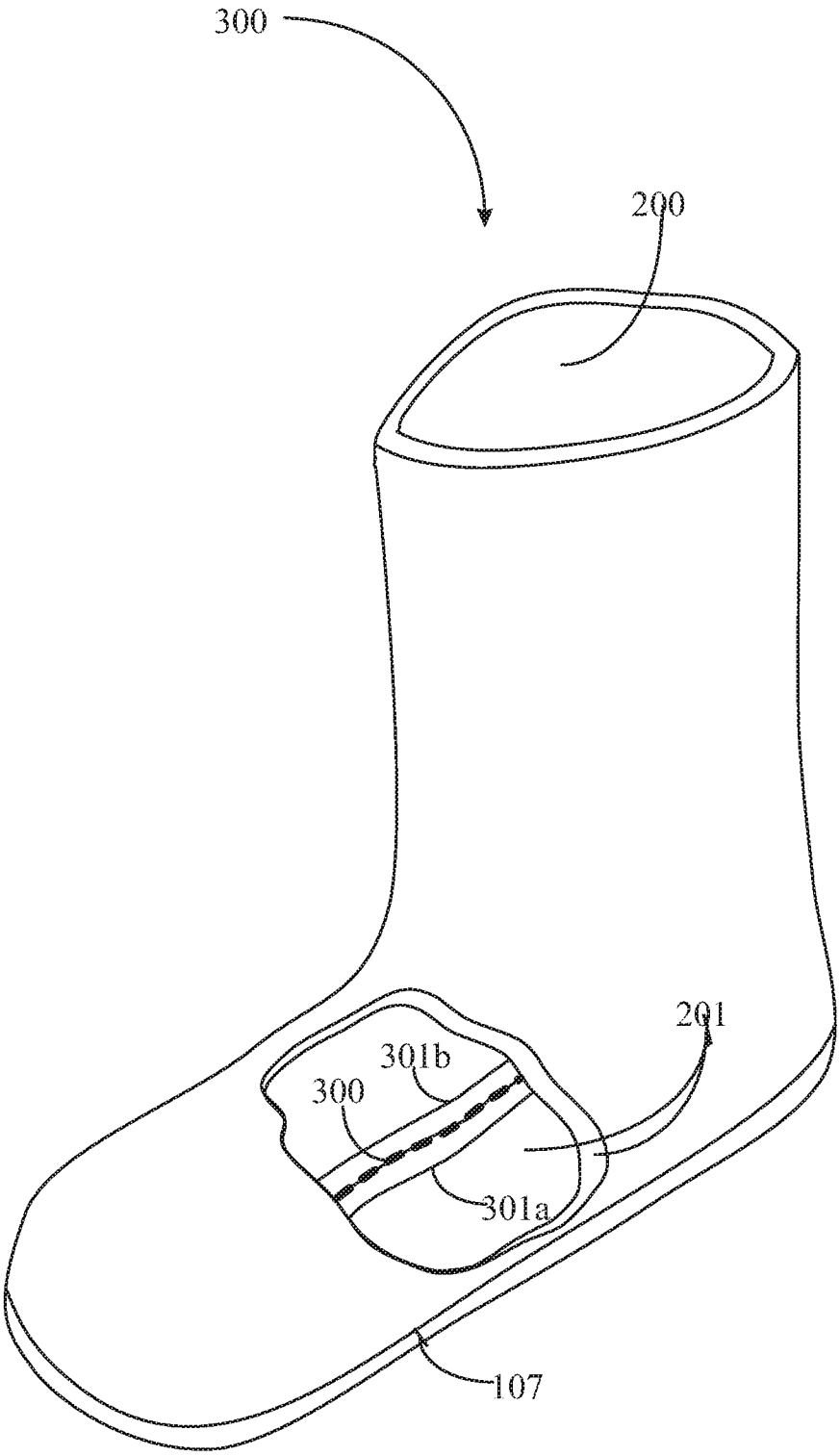
FIG. 3 is a perspective view of a foot covering according to another embodiment of the present invention.

FIG. 3 is a perspective view of a foot covering 300 according to another embodiment of the present invention. Foot covering 300 is analogous to foot covering 106 of FIG. 1 with the exception of the orientation of the opening. Foot covering 300 includes fleece material 200 and Sherpa material 201, as well as resilient stretch material 107.

In this embodiment an opening 300 is provided through the sole of foot covering 300 in a direction substantially in line with the foot inserted into the bootie. In this case opening 300 is covered by material flaps 301*a* and 301*b*. Opening 300 may be of a length sufficient to allow a user to fully extend the foot through the covering to the outside. Opening 300 may be protected on the bottom side of the sole by rubberized flaps or a contiguous flap such as with a Z-cut design placed through the sole bottom and enclosing the opening with a flap on the bottom and one on the inside of the sole.

Figure 4:
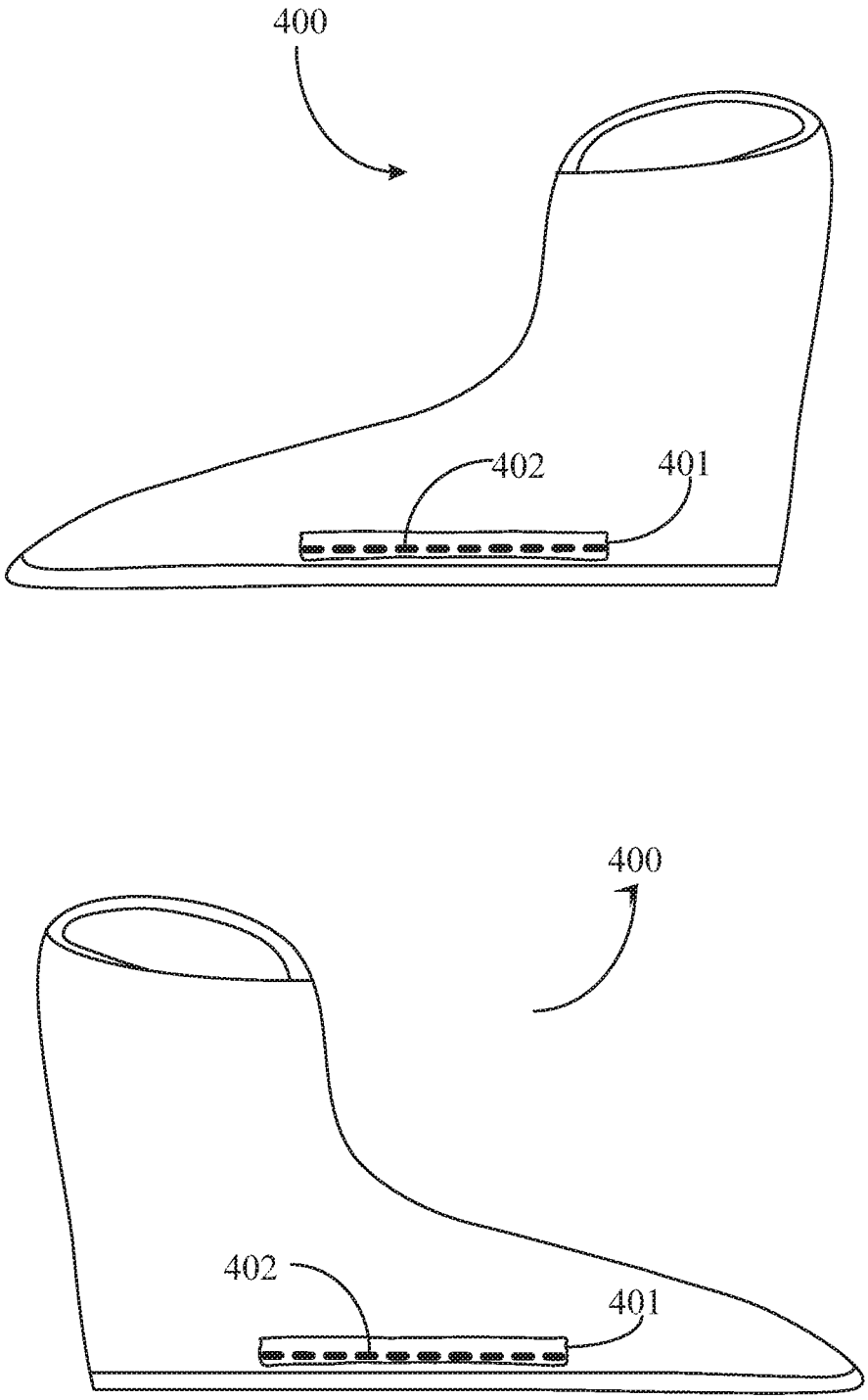
FIG. 4 is an elevation view of a foot covering according to another embodiment of the present invention.

FIG. 4 is an elevation view of a foot covering 400 according to another embodiment of the present invention. Foot covering 400 is analogous in description to foot coverings described further above with the exception of the orientation of the opening. In this embodiment an opening 402 is provided through the side of foot covering 400 instead of through the sole of the covering as was described further above. In this embodiment opening 401 may be provided on the "left" side or on the "right" side of the bootie just above and parallel to the sole of the bootie.

In one embodiment foot covering 400 has two openings, one opening provided on the "left" side and one opening provided on the "right" side of the bootie. Opening 401 is protected by a flap 401. In this view the opening flap 401 is visible on the outside surface of the foot covering. The opening may also be protected by a similar flap on the inside of the bootie. In one embodiment the sole portion of foot covering 400 is extended to a portion of the side of the covering in area sufficient to support the length of and location of the opening. In this way the opening is still provided through the material comprising the sole of the foot covering.

Figure 5:
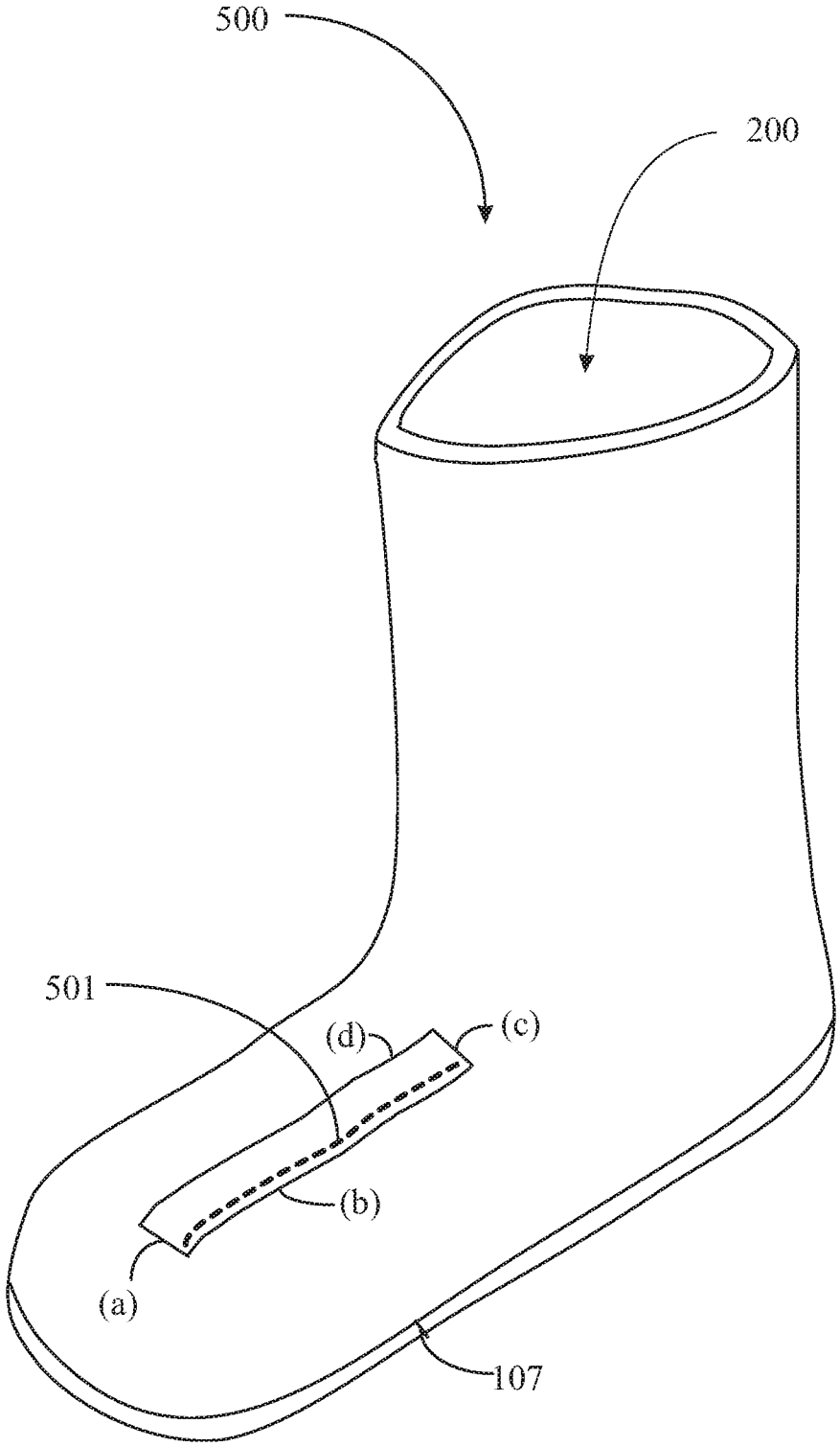
FIG. 5 is a perspective view of a foot covering according to another embodiment of the invention.

FIG. 5 is a perspective view of a foot covering 500 according to another embodiment of the present invention. Foot covering 500 is analogous in description to foot coverings described further above with the exception of the orientation of the opening. In this embodiment an opening 501 is provided through the top of foot covering 500 instead of through the sole of the covering, or elsewhere as was described further above. In this embodiment opening 401 may be oriented across the top, in the direction of the foot as shown in FIG. 5, or at any other angle. Opening 501 is made by slitting the top material of the foot covering for a specific length, and then sewing a flap defined by sides (a), (b), (c) and (d) to the material of the top of the foot covering along sides (a), (b) and (c), but not (d).

Other areas of the foot covering may also be considered for hosting such an opening without departing from the spirit and scope of the present invention. For example, opening 402 could be provided closer to the heel or toe of the foot covering. Opening 402 might be provided across the back portion of the foot covering above the heel of the bootie. Opening 402 may be provided across the top surface of the bootie in line with or orthogonal to the line of the foot inserted into the bootie.

Figure 6:
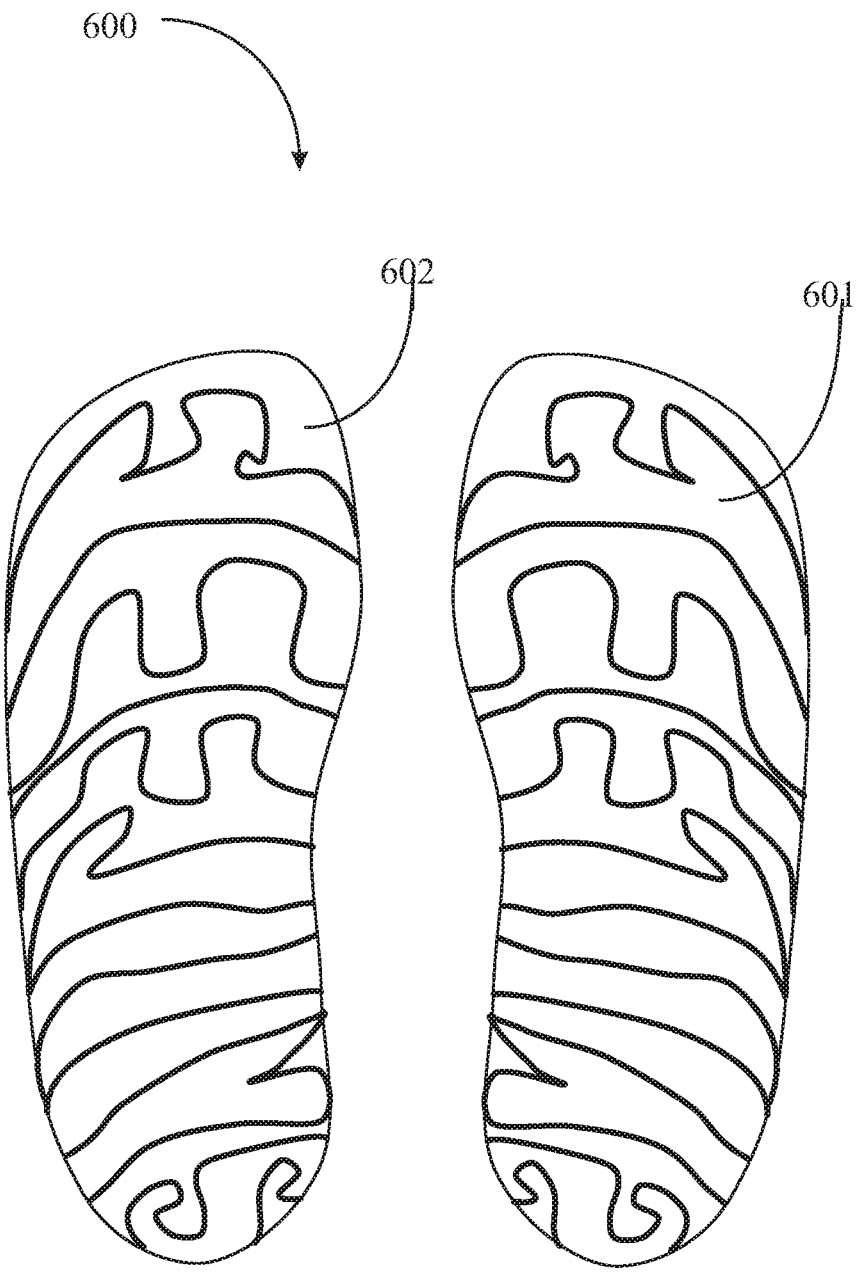
FIG. 6 is an elevation view of the soles of the foot coverings of FIG. 1 according to an embodiment of the present invention.

FIG. 6 is an elevation view of soles 600 of foot coverings of FIG. 1 according to an embodiment of the present invention. Soles 600 are analogous to soles fabricated from a resilient stretchable material referred to in FIG. 1 as material 107. In this embodiment the openings are hidden and are therefore not illustrated in this depiction.

Soles 600 may be printed or otherwise treated with one or more applications of a three dimensional rubberized ink 601 known as "Puff" ink in the art. Puff ink expands when heated to provide a three dimensional surface. In this example Puff ink 601 is applied according to a tread pattern over resilient sole material 602. The tread pattern might be a standard pattern tied to a specific version or batch of fabricated product where a next batch may include a different tread pattern. In one embodiment tread patterns might be patterns selected by user who order the sweatpants. In another embodiment a customer may create a unique (personalized) tread pattern through a graphics interface at the time of order of the product.

In one embodiment the tread pattern includes a word, symbol, or numerical indicia, created in mirror fashion so as to be readable by looking at an imprint of the sole of the bootie made on an imprintable ground surface. In one embodiment the tread pattern is unique to a user for the purpose of leaving a personalized imprint somewhere that might identify the wearer to other persons. In one embodiment users who find and photograph foot imprints left by a proprietary or custom tread pattern might produce such images to get discounts on purchases of the product. Functionally speaking, the raised tread pattern provides a superior non-skid surface for walking. The opening, if through the sole, may be hidden by rubberized flaps that may be overprinted with the tread pattern further obscuring the location of the opening in embodiments utilizing "hidden" openings.

It is noted herein that the openings are described as provided in foot coverings in at least one embodiment for sweatpants. This should not be construed as a limitation to the practice of the present invention. In one embodiment similar openings may be provided in mittens or hand coverings that might be sewn into or otherwise provided with a long-sleeved sweat shirt or jacket. In one embodiment sweatpants with openings in foot coverings and sweat shirt or jackets with openings in hand coverings may be provided and marketed as matching or paired items that might also be marketed separately.

Figure 7:
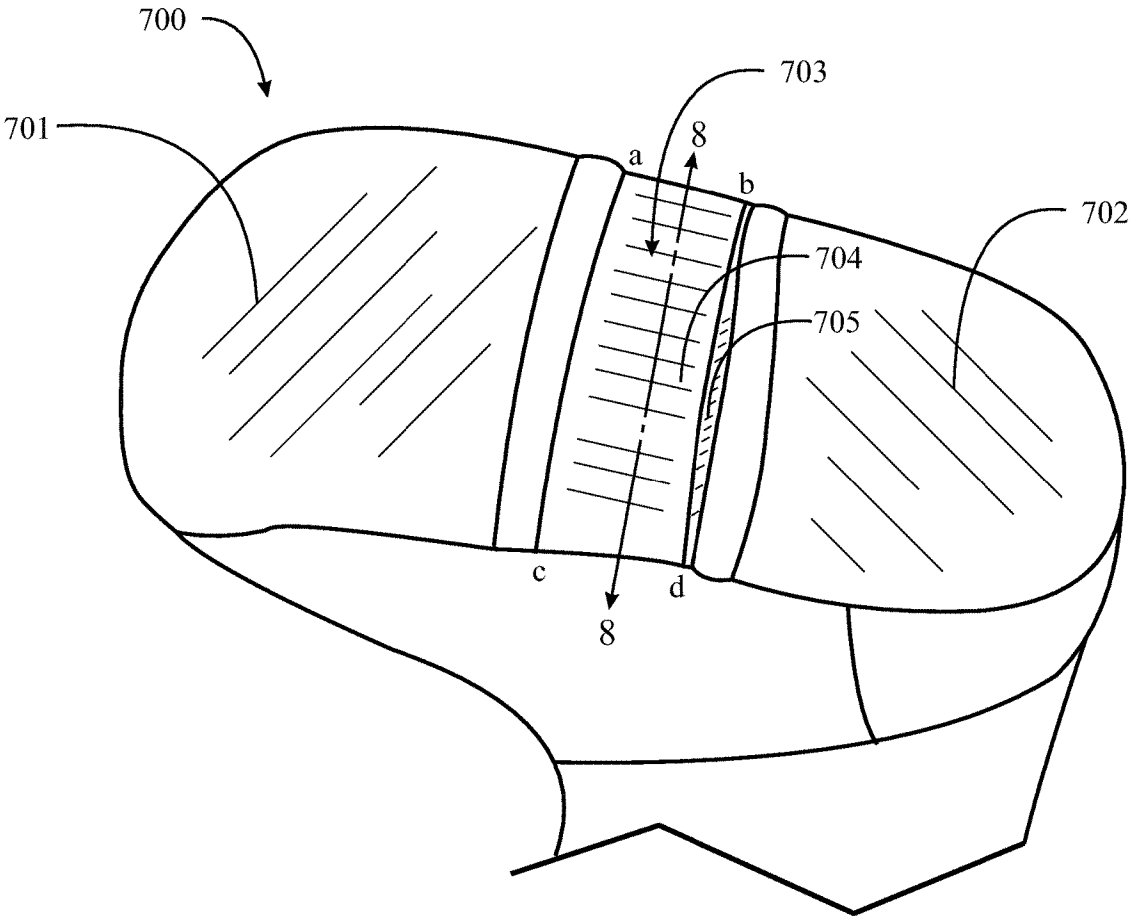
FIG. 7 is a plan view of a sole of a foot covering illustrating an opening in another embodiment of the invention.

FIG. 7 is a plan view of a sole of a foot covering in a garment illustrating an opening in another embodiment of the invention. Foot covering 700 in FIG. 7 is analogous to foot covering 106 in FIG. 1, shown in considerably more detail. Foot covering 700 has a toe region 701, a heel region 702, and a protected opening 703 between the toe and heel regions. Opening 703 is substantially rectangular in this example, although this is not a limitation in practice of the invention. Rectangular opening 703 is defined by corners a, b, c and d, providing edges a-b, b-d, d-c and c-a. Opening 703 has a length from a to c, and a width from a to b.

Opening 703 is protected by two material flaps 704 and 705 in this embodiment. Flap 703 is sewn to material of the foot covering along edges a-c, a-b and c-d, but not sewn along edge b-d. In this view surface of flap 704 is exposed along with the sole areas on the bottom of the foot covering.

Flap 705 is, in this view, beneath flap 704 (overlapped), and is sewn to edges a-b, b-d, and d-c, but not to edge c-a. There are thus two layers of flap material, one above the other, over the area of opening 703, but there is passage under flap 704 from edge b-d into the interior of the foot covering, the passage passing between flaps 704 and 705, and into the interior at edge a-c beneath flap 704.

In this embodiment flaps 704 and 705, each sewn along three edges of opening 703, are fabricated of elastic material different and thinner than the material of the foot covering through which opening 703 passes. The flap material may be elastic in the length direction, the width direction or in both directions. An important purpose of the elasticity is to facilitate a person passing his or her foot through the opening from within the foot covering, after which the opening may be wrapped around the person's ankle or lower leg, with the bare or stockinged foot outside the foot covering of the garment.

Figure 8:
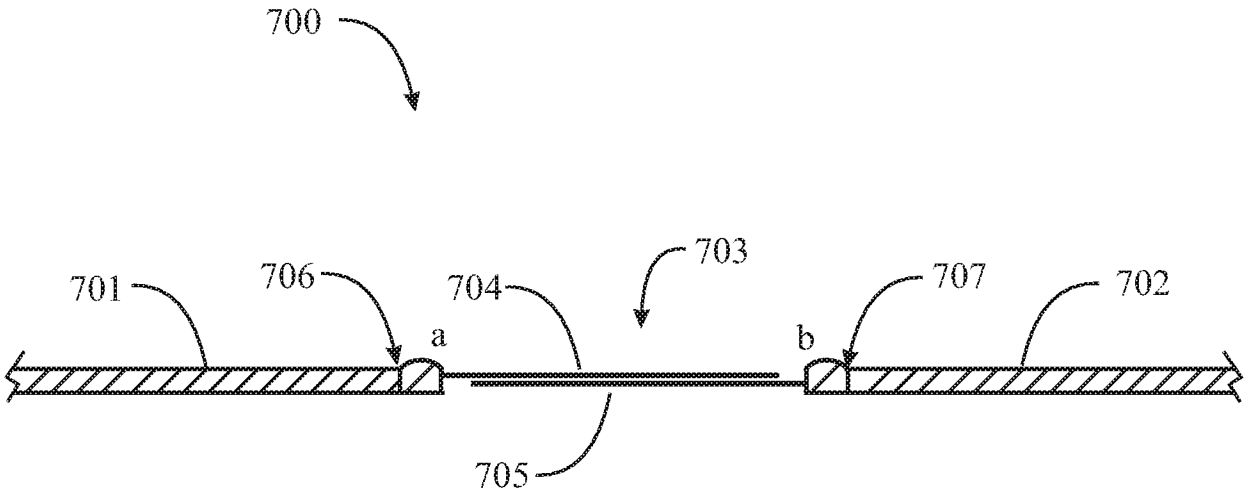
FIG. 8 is a perspective view of the opening seen in plan view in FIG. 7.

FIG. 8 is a cross-section view along section line 8 of opening 703, through the flaps 704 and 705, seen in plan view in FIG. 7. In this example a line of reinforcing stitching is made along lines 706 and 707 parallel with edges a-c and b-d. This is optional. Section view FIG. 8 illustrates clearly how elastic flaps 704 and 705 overlap, providing a protected opening 703, wherein a person may insert the foot, or in another embodiment the hand, between the flaps and through opening 703. The elastic flaps deform in contact with the appendage passing through the opening. Flap 704 is shown joined along long edge a-c, and flap 705 is shown joined along long edge b-d. This is typically by sewing the flaps to the edges.

Figure 9:
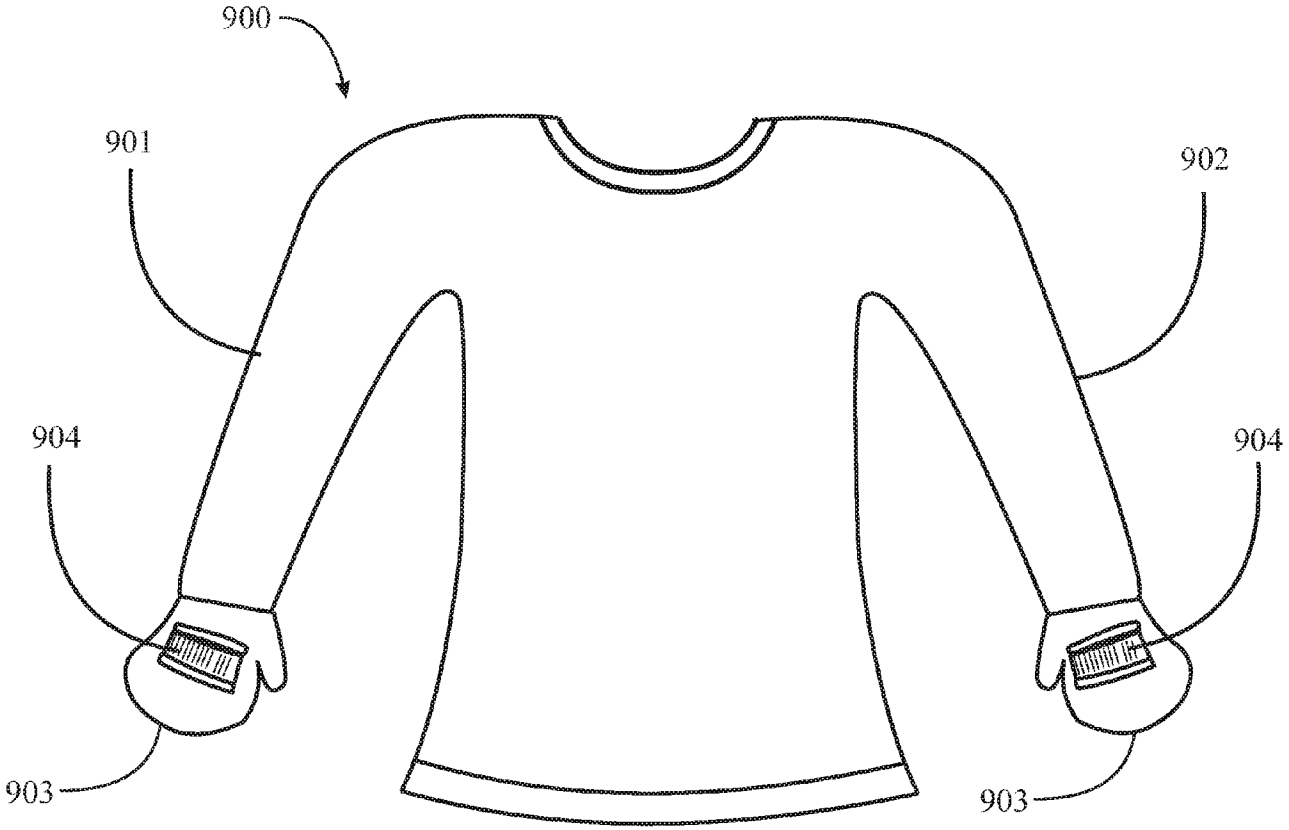
FIG. 9 is a front view of an upper garment incorporating an opening as shown in FIGS. 7 and 8.

FIG. 9 is a front view of an upper garment 900. incorporating an opening as shown in FIGS. 7 and 8. Garment 900 has a left and a right sleeve 901 and 902, each ending in a mitten 903 that is stitched to the wrist end of the sleeve. It will be apparent to the skilled person that the mitten may take any of several forms, and may be in the form of a glove with appendages for the thumb and each of the fingers.

An opening 904 is shown on the back of each of mittens 903, and this opening has the construction described above for opening 703 in FIG. 7, and shown in cross-section in FIG. 8. A user wearing this upper garment may pass the hand from within the mitten on either hand from inside to outside, such that the opening will then encircle to wrist of the lower arm. In alternative embodiments the opening may be implemented in the palm of the mitten or glove, in the wrist area of the sleeve at any place around the circumference, or at any other convenient place on the garment.

It will be apparent to one with skill in the art that the clothing article of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

What is claimed is:

1. A protected passage in first fabric of a garment, comprising:

a passage through the first fabric of an area sufficient to pass a hand or foot, the passage formed between a first and second side along a width, and a first and second side along a length, thereby forming a rectangle;

a first flap of elastic fabric, different from the first fabric, stitched continuously along the first side along the length, the first side along the width and the second side along the width forming a first opening along the second side along the length; and a second flap of elastic fabric, different from the first fabric, stitched continuously along the second side along the length, the first side along the width and the second side along the width forming a second opening along the first side along the length, the second flap of fabric overlapping the first flap of fabric for more than half of the width creating only two layers of material providing the passage;

wherein the passage is formed between the first and second flaps via the first opening and second opening, and elasticity of the fabric of the first and second flap is sufficient to enable one or both flaps to deform sufficiently to pass a human hand or foot and to wrap around a limb supporting the human hand or foot.

2. The protected passage of claim 1 wherein elasticity of the first and the second flaps are formed of fabric elastic in one or both directions of the width and the length of the substantially rectangular opening.

3. The protected passage of claim 1 implemented in the sole region of a foot covering of a garment, the length of the rectangular opening oriented across the sole at a right angle to a direction from a heel area to a toe area of the foot covering.

4. The protected passage of claim 1 implemented on a region of a foot covering of a garment below the ankle area and above the sole of the foot covering.

5. The protected passage of claim 1 implemented in the back of a glove or mitten hand covering of an upper garment.

6. The protected passage of claim 1 implemented in a palm region of a glove or mitten hand covering of an upper garment.

7. The protected passage of claim 1 wherein a length and width of the first and second flaps are equal to the length and width forming the rectangle.

8. The protected passage of claim 7 further comprising reinforcement added along one or more of the first and second sides along the width of the rectangle.

* * * * *